United States Patent [19]

Ward et al.

[11] Patent Number: 4,528,042

[45] Date of Patent: Jul. 9, 1985

[54] METHOD FOR PRODUCING SUPERPLASTIC ALUMINUM ALLOYS

[75] Inventors: Bennie R. Ward; Richard F. Ashton, both of Richmond, Va.

[73] Assignee: Reynolds Metals Company, Richmond, Va.

[21] Appl. No.: 572,542

[22] Filed: Jan. 20, 1984

Related U.S. Application Data

[63] Continuation-in-part of Ser. No. 479,256, Mar. 28, 1983, Pat. No. 4,486,242.

[51] Int. Cl.[3] ..... C22F 1/04

[52] U.S. Cl. ..... 148/11.5 A; 148/12.7 A; 420/902

[58] Field of Search ..... 148/11.5 A, 12.7 A, 148/2; 420/902

[56] References Cited

U.S. PATENT DOCUMENTS 3,847,681 11/1974 Waldman et al. ..... 148/12.7 A
4,092,181 5/1978 Paton et al. ..... 148/12.7 A

*Primary Examiner*—R. Dean
*Attorney, Agent, or Firm*—Alan T. McDonald

[57] ABSTRACT

A method for producing superplastic aluminum alloys, including a hot/warm rolling operation is disclosed. Use of this method eliminates the need for overaging the material prior to rolling.

4 Claims, 3 Drawing Figures

METHOD FOR PRODUCING SUPERPLASTIC ALUMINUM ALLOYS

CROSS-REFERENCE TO RELATED APPLICATIONS

This is a continuation-in-part of U.S. application Ser. No. 479,256, filed Mar. 28, 1983, U.S. Pat. No. 4,486,242.

BACKGROUND OF THE INVENTION

1. Field of the Invention

The present invention relates to superplastic aluminum alloys and particularly to an improved method for producing such materials.

2. Description of the Prior Art

Efforts to produce improved superplastic aluminum alloys, i.e., alloys of aluminum which can be superplastically formed using gas pressure or vacuum have been numerous and extensive as evidenced by the plethora of prior art describing such materials and methods for their preparation.

Among this prior art, two relatively recent techniques appear to produce commercially valuable superplastic materials.

The first of these techniques is described in U.S. Pat. No. 3,847,681 issued Nov. 12, 1974, to Waldman et al. This technique, which is presented schematically in FIG. 1 hereof, involves the steps of:

(a) solution heat treating the starting material for from 8–48 hours at a temperature greater than 860° F.;

(b) slow cooling the product of step (a) to an overage temperature, i.e., about 775° F.;

(c) overaging at about 775° F. for 3 to 5 hours;

(d) slow cooling the product of step (c) to a temperature of between about 450°–500° F. and optionally holding at this temperature for up to 4 hours;

(e) plastically deforming the material (from 40–80%) at a temperature between about 450° and 500° F.; and (f) rapidly recrystallizing at a temperature of between about 800° and 900° F.

This process reportedly provides a fine grain structured 7000 series alloy.

Photomicrographs of 7475 alloy prepared using this procedure demonstrate that, although the grains are relatively fine, their aspect ratio, i.e., length to width ratio, is quite high.

The second prior art process which produces acceptable material is that described in U.S. Pat. No. 4,092,181 issued May 30, 1978 to Paton et al. This patent describes a process for preparing material reportedly of finer grain than that described in the U.S. Pat. No. 3,847,681, according to a somewhat shorter procedure, and in heat treatable alloys other than those of the U.S. Pat. No. 3,847,681, which additional alloys may include chromium as an alloying element.

The process of the U.S. Pat. No. 4,092,181 is quite similar to that of the U.S. Pat. No. 3,847,681 except that it offers the option of cold water quenching after solution heat treat and before overage (i.e., between steps (a) and (c) of U.S. Pat. No. 3,847,681) and eliminates the need entirely for the optional soaking or holding of step (d) of the U.S. Pat. No. 3,847,681.

In each of these references, the mechanical work required to induce the lattice strain necessary for recrystallization is performed while the material is warm, i.e., at between 400° and 650° F. Although the U.S. Pat. No. 3,847,181 alludes to the feasibility of performing such work at lower temperatures, i.e., "below the overage temperature" there is no disclosure of "cold" rolling, i.e., rolling at room temperature.

Both of the foregoing processes can provide useful superplastic materials under some conditions as evidenced by evaluation thereof by the inventors of the present process. These prior art processes are, however, somewhat difficult to work into a commercial production operation because of the apparent requirement that the material be subjected to an overaging step requiring holding the same at a temperature of from about 700° F. to about 800° F. for a period of from about 2 to about 8 hours before cooling to a lower temperature to plastically reduce the metal. The pressure of such a step in the manufacturing operation makes it essentially a batch-type process which requires substantial material handling and does not take advantage of the obvious economics inherent in a continuous rather than batch process system. The reasoning for this statement is that plastic deformation is done below the recovery temperature and the metal is limited in the percent reduction it can take. By hot/warm rolling at the temperatures as taught by the present invention the metal can be reduced a much greater amount, thus allowing reduction to be taken at a much greater starting thickness. Avoiding the necessity of rolling a relatively thin starting slabs (<1.5") allows the metal to be processed into a coil which is more amenable to a continuous processing operation.

The advantages of fine and equiaxed grain structure in superplastic materials are discussed in detail in "Superplasticity", J. W. Edington, K. N. Melton and C. P. Cutler, *Process in Materials Science*, Vol. 21, No. 2, pp. 63–170, Pergammon, N.Y. (1976).

SUMMARY OF THE INVENTION

According to the present invention, it has been found that substantially improved superplastically formable materials, i.e., materials having extremely fine and equiaxed grain structures, can be produced by a process which is substantially more commercially acceptable when the overaging step is omitted entirely and the aluminum is cooled from the solution heat treat temperature to a temperature of between about 600° F. and about 700° F. and rolling commenced at this temperature. If hot rolling is initiated above the indicated temperature range of this patent, the resultant final grain size will be large (>20 μm). Optionally, the aluminum may be held at this temperature for up to eight hours with no detrimental affect.

DESCRIPTION OF THE DRAWINGS

FIG. I is a graphic representation of the process described in U.S. Pat. No. 3,847,681.

FIG. II is a graphic representation of the process described in U.S. Pat. No. 4,092,181.

Figure 1:
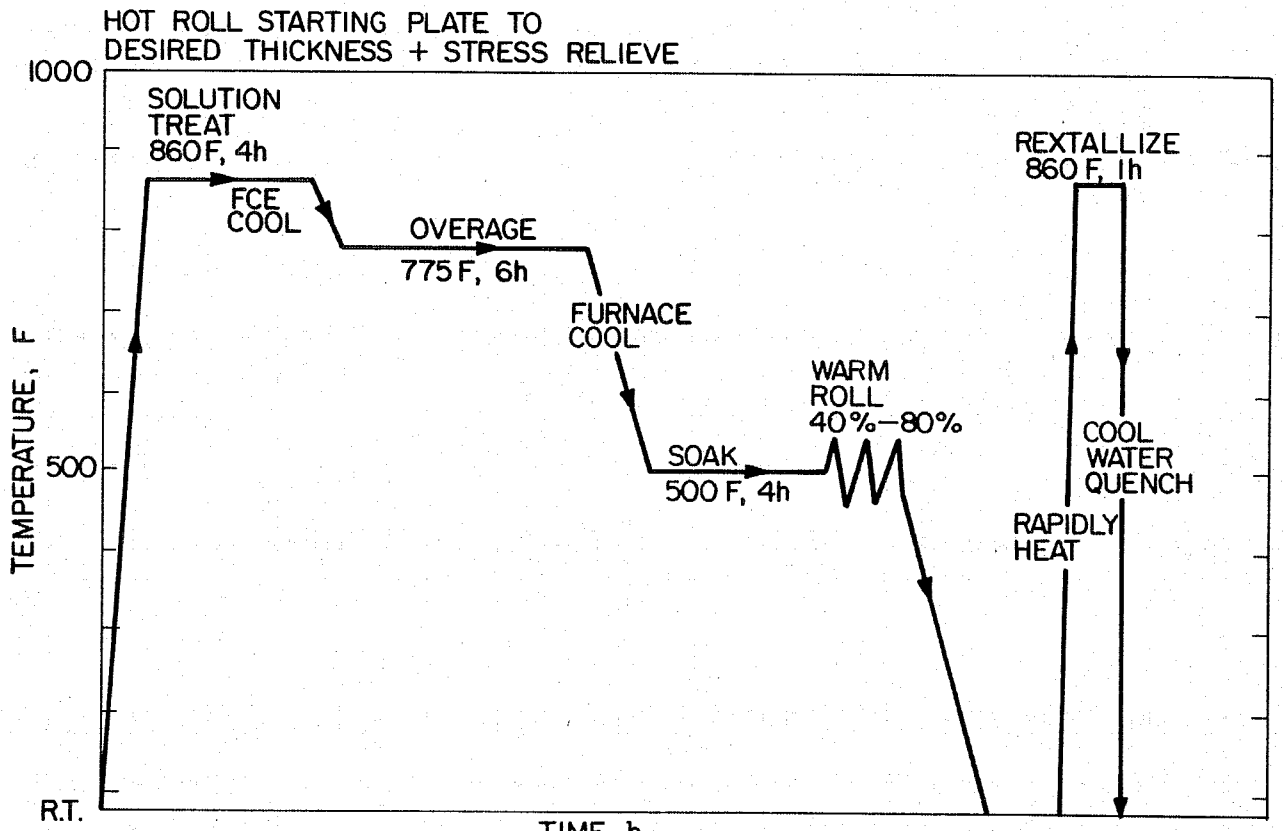
Figure 2:
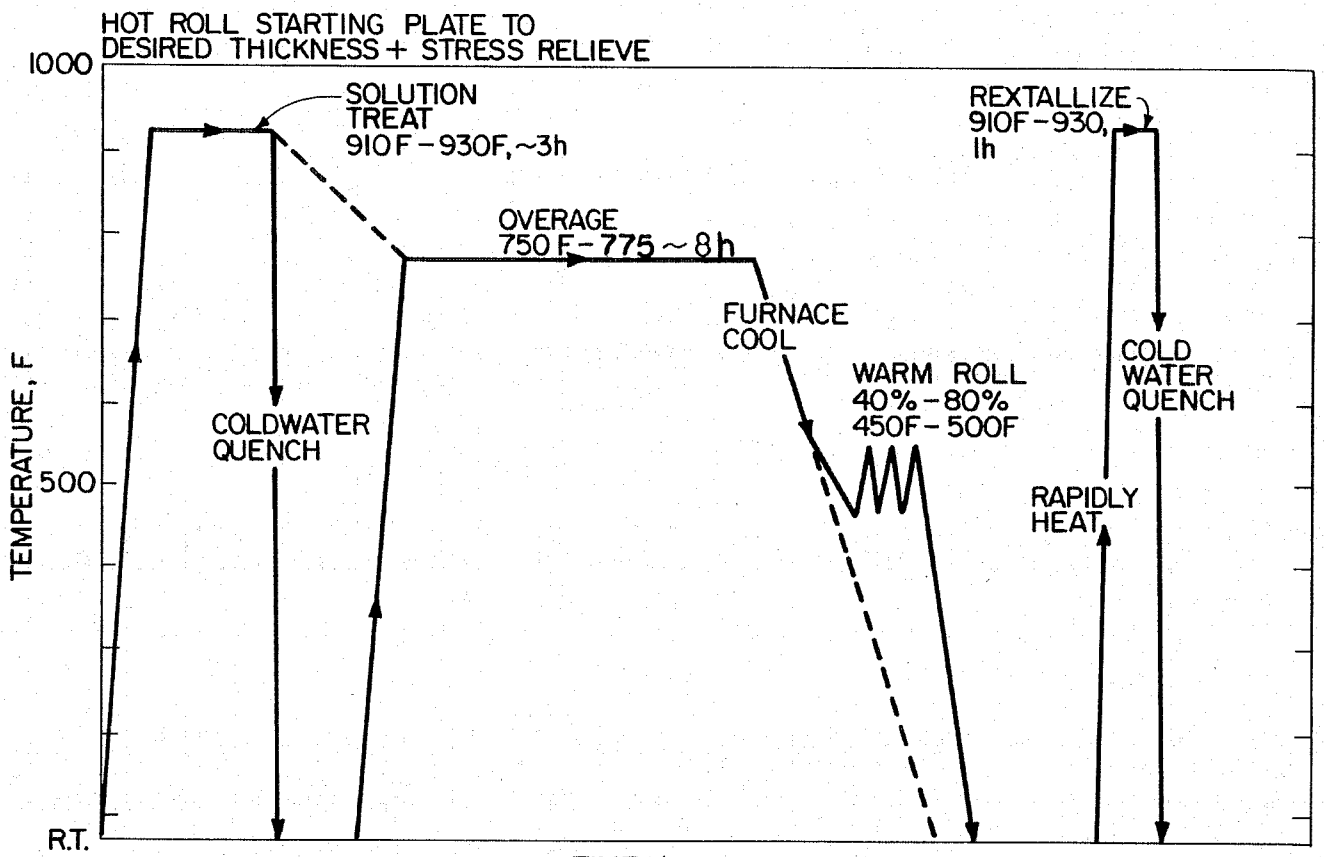
Figure 3:
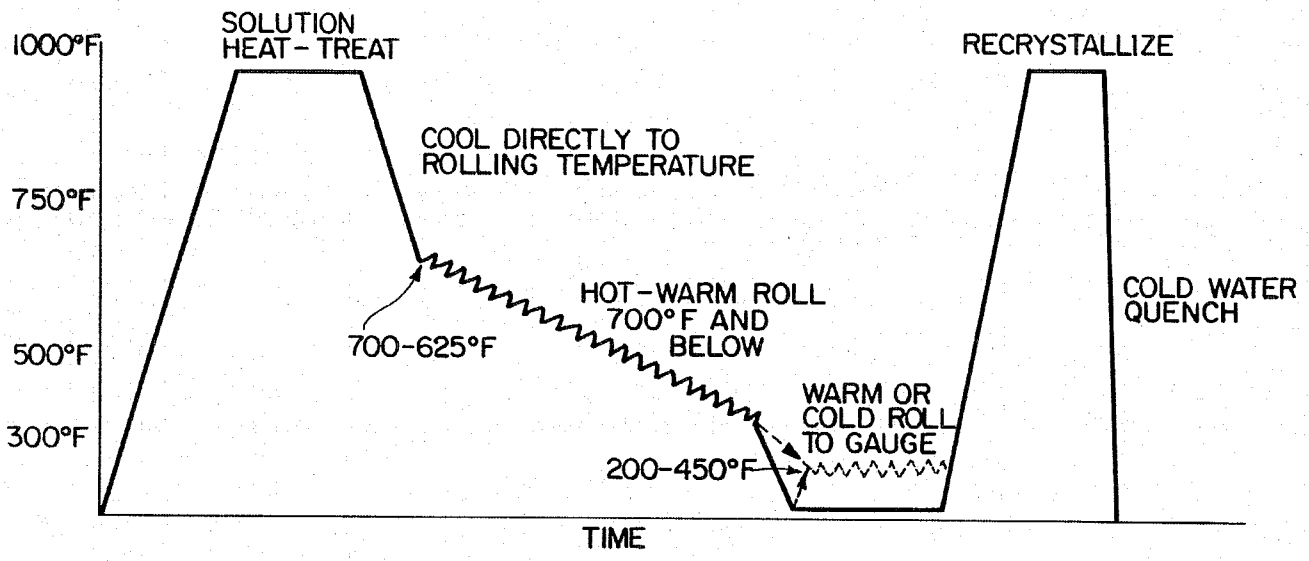

FIG. III is a graphic representation of the process of the present invention.

This invention consists of a method for producing superplastic aluminum sheet or plate, which method is readily practiced in a plant environment. This method is applicable to heat-treatable alloys, particularly those of the 2000 and 7000 series. When aluminum sheet has been processed according to the present invention, very large amounts of plastic deformation from 50 percent to several hundred percent can be obtained to produce complex parts which would normally be produced by joining several parts formed by conventional processes.

The general time-temperature cycles necessary to accomplish the invention are shown in FIG. III. The processing sequence consists of solution heat-treating, hot/warm rolling, either cold rolling or additional warm rolling, with optional reheating if necessary, to final gauge, followed by recrystallizing. The correct combination of these process steps will result in a product with an equiaxed, fine grained (<20 μm) microstructure, which is capable of exhibiting superplastic behavior at elevated temperatures.

The alloys used in the work described herein was plant produced 7475 and experimental lab produced 7XXX alloys. All have shown superplastic capabilities as a result of the treatment taught by this invention. Our discussion of the details of the fabrication practice will deal primarily with 7475 alloy, although similar practices can be applied to all the 7000 series alloys as well as to other heat-treatable aluminum alloys, including, but not limited to 2034, 2219, 2124, 2014 and heat treatable 6000 series alloys.

SOLUTION HEAT-TREATING

The solution heat-treating step involves heating the starting aluminum slab to a high enough temperature so as to dissolve the normally soluble phases. This treatment will not take into solution the insoluble or dispersoid particles; therefore, it is best to start with an alloy that is low in alloying impurities such as iron and silicon. Heat-treating in the range of from about 860° to about 925° F. has been found satisfactory. The upper limit of this temperature range is dicated by the initiation of melting. The time of treatment in this temperature range varies from about ¼ to about 48 hours depending upon the alloy and slab thickness being treated. After solutioning of the precipitate, the slab is then cooled directly to the hot rolling temperature described below. Slabs with thicknesses from 1.00" to 4.50" and thicker can be processed into sheets of various gauges using this practice. The specific time and temperature parameters required to obtain satisfactory heat treating will depend upon the alloy under treatment and are readily determinable or known to the skilled artisan.

COOLING

Following solution heat-treatment, the slab is cooled to the hot rolling temperature described below. Although a preferred cooling rate is about 50° F./hr when the starting material is 1½" thick aluminum alloy slab, cooling rates of between about 20° F. and about 100° F./hr may be used depending upon the thickness of the slab being treated, the alloy composition of the plate and the operating environment of the producing plant. The examples presented below specify useful cooling rates for specific alloys. However, for other alloys optimum cooling rates within the foregoing range and as dictated by the foregoing parameters, may be determined on a case by case basis.

HOT/WARM ROLLING

This is perhaps the most critical step in the process of the present invention and that which permits elimination of the conventionally practiced overaging. Unlike the processes to produce superplastic aluminum sheet which limit the initial rolling temperature to a maximum of 500° F. (i.e., warm rolling), according to the present invention, it is essential that at the start of rolling the metal be "hot". "Hot" in the present context means above the recovery or stress relieving temperature of the metal. During, i.e., in the course of, the hot rolling process the temperature of the aluminum will drop below the recovery or stress relieving temperature, to a warm rolling condition whereupon, without further treatment of the rolled metal, warm rolling will commence and equivalent cold work will be imparted to the metal in this condition.

Hot rolling must be initiated at a temperature of between about 600° F. and about 700° F. to obtain the fine, equiaxed grain structure which is the ultimate goal in producing a superplastic product.

At hot rolling temperatures above about 700° F. the sheet product demonstrates an unacceptably large grain size (>20 μm) while at hot rolling temperature below about 600° F., rolling is essentially impractical because the metal work hardens and "alligators", i.e., cracks.

A hold at the hot rolling temperature is not necessary, however, experience has indicated that holds of up to eight hours at this temperature do not have any adverse effect on the process. Holds at temperatures in excess of 700° F., eg. 750°-775° F., are detrimental. The preferred practice is, however, to roll the metal as soon as it reaches the hot rolling temperature of 700°-600° F. in the cooling operation.

It is necessary in order to achieve the optimum results intended by the present invention (i.e., <20 μm grain size, highly equiaxed) that some equivalent cold work be imparted to the metal during the rolling operation and this can only be achieved if the rolling schedule is initiated in the aforementioned 600°-700° F. temperature range and rolling is completed only after the sheet has cooled to below about 500° F. on exit from the rolling mill. In the case of a final cold rolling operation, as will be described below, this limitation is met by completing the hot/warm rolling at a temperature below about 500° F. In the case of a final warm rolling operation, which will also be described below, this limitation is met by conducting the warm rolling at a temperature below about 500° F.

In the case of final cold rolling, and under normal hot rolling conditions, if the rolling is initiated at a temperature of between about 600° F. and about 700° F. the plate will cool to below about 500° F. before rolling to final coiling gauge (i.e., about 0.3") is completed and sufficient equivalent cold work will be imparted to induce strain energy adequate to permit nucleation of many fine grains in the recrystallization step. In high pressure rolling operations, it may be necessary to stop rolling at some intermediate gauge, perhaps 0.600"-1.250", to cool the metal to 500° F. before final reduction to the coiling gauge to insure that the final portion of the rolling operation is performed below the recovery or stress relieving temperature. Such holds in the rolling operations are intended to be included, if necessary, in the process of the present invention.

WARM OR COLD ROLLING

The hot line gauge metal is then reduced to the final gauge by either warm or cold rolling. This operation is performed to obtain the desired gauge of sheet and to impart more cold work which induces more strain energy to insure fine grain recrystallization during the final heat treatment.

In the case of cold rolling, the metal from the hot/warm rolling operation is allowed to cool to ambient temperature. Once this temperature has been reached, cold rolling may then be accomplished.

In the case of warm rolling, the metal from the hot/-warm rolling operation may be permitted to cool to the desired warm rolling temperature, such as between about 200° F. and 450° F., and warm rolled immediately upon reaching temperature. Alternatively, the metal may be permitted to cool to ambient temperature and be reheated to the desired warm rolling temperature.

With the method used, the hot line gauge metal can be produced in coil form. This is the most efficient and cost saving way for metal to be processed in a modern metal processing plant. There are no expensive hand-s-on or batch operations in this method. The warm or cold rolling is continuous in that the final rolled metal is still in coil form. In this coil configuration the metal can be recrystallized on a continuous heat treating (CHT) line which reaches the desired temperature in approximately two minutes.

RECRYSTALLIZATION HEAT-TREATING

After achieving the proper precipitate size and distribution and introducing sufficient strain energy by hot/-warm and warm or cold rolling to cause recrystallization under proper conditions (as well as to reduce the gauge thickness the desired amount), a recrsytallization heat treatment operation is performed. This consists of a rapid heating of the material to a high enough temperature so as to activate the recovery and recrystallization processes to nucleate new grains. However, the time and temperature conditions are such that any substantial grain growth is avoided. A proper precipitate size and distribution (obtained during the hot/warm rolling) aids in providing many nucleation sites so that extremely fine equiaxed grains which are stable during superplastic forming are created. Rapid heating from room temperature to from about 860° to about 925° F. has been found satisfactory to achieve the required recrystallization. As in the case of the initial solution heat treating, the upper limit of the temperature range is dictated by the initiation of melting. The time of treatment in the temperature range varies from about 5 minutes to about 2 hours for sheets in the thickness range of from about 0.060" to about 0.250". This treatment will of course vary from alloy to alloy and these parameters are well known to the skilled artisan.

Using the foregoing method it is envisaged that superplastic 7475 sheet in final gauges of from about 0.250" and above to about 0.060" or lower can be produced, employing various amounts of rolling (hot/-warm and warm or cold) of from about 64% to as high as about 91% without any overage and starting with slab thicknesses from about 1.500" or greater.

EXAMPLE I

Two slabs of Alloy 7475 1.50" thick were solution heat treated for two hours at 910° F. and then cooled to 680° F. or 625° F. at a rate of 50° F./hr. The slabs were then immediately hot/warm rolled with no hold to a thickness of 0.290" and immediately cold rolled to 0.125" (56% cold reduction) and 0.900" (68% cold reduction). The metal was then solution heat treated (recrystallized) for five minutes at 920° F. in a salt bath.

These products demonstrated the following grain size properties:

TABLE I

| Sam. I.D. | Avg. Dia. | Grains/ $MM^2$ | ASTM | * Avg. A. Dia. | * Avg. B. Dia. | Aspect Ratio A/B |
|---|---|---|---|---|---|---|
| 625° F. (.090") | 7 | 22,300 | 11.5 | 7.7 | 6.1 | 1.3 |
| 680° F. (.090") | 7 | 21,200 | 11.4 | 8.3 | 6.0 | 1.4 |

all grain diameter in μm

EXAMPLE II

Three slabs $1\frac{3}{4}$" thick of 7475-F were solution heat treated for two hours at 910° F. and then cooled to 680° F., 650° F. and 625° F. at a rate of 50° F./hr. The slabs were immediately hot/warm rolled without a hold to a thickness of 0.290" and cold rolled to 0.125" (56% cold reduction) and 0.090" (68% cold reduction) The metal was then solution heat treated (recrystallized) for one half hour at 925° F. in a preheated air recirculating furnace.

The products demonstrated the following grain size:

TABLE II

| Sample | Avg. Dia. | Grains/ $MM^2$ | ASTM | * Avg. A. Dia. | * Avg. B. Dia. | Aspect Ratio A/B |
|---|---|---|---|---|---|---|
| 625° F. (.090") | 8.5 | 13,500 | 10.8 | 11.4 | 7.0 | 1.6 |
| 650° F. (.090") | 9.5 | 10,700 | 10.5 | 13.4 | 7.6 | 1.8 |
| 680° F. (.090") | 9.6 | 10,700 | 10.4 | 13.7 | 7.5 | 1.8 |

all grain diameter in μm

*A. Average grain dimension in the L-T Plane and Parallel to the rolling direction i.e. the average grain length.

*B. Average grain dimension in the L-T Plane and Perpendicular to the rolling direction i.e. the average grain thickness.

EXAMPLE III

Alloy 7475 slab 1.75" thick was solution heat treated by heating to 890° F. at a rate of 100° F./hr and held at a temperature of 890°-900° F. for 2 hours. The slab was then cooled to 625° F. at a rate of 42° F./hr. Two different practices were then performed to determine what effect, if any, holds at the 625° F. temperature might have if they became necessary in an operating environment. Sample A was held at the 625° F. temperature for 1 hour while sample B was held at the same temperature for 8 hours. Both samples were hot/warm rolled to 0.292" with a finishing temperature of 445° F. and then cold rolled to a final gauge of 0.900".

The samples were then solution heat treated, i.e., recrystallized, at 900° F. for $\frac{1}{2}$ hour in an air furnace.

The hold at 625° F. had no significant apparent effect on grain size and both practices produced acceptable (<20 μm grain) material. The material having the one hour hold had slightly more uniform grain size at the center thickness. The materials produced in this test demonstrated a somewhat more equiaxed structure than material made using a similar practice where one hour and eight hour holds at 700° F. were incorporated prior to commencement of hot rolling at 700° F.

EXAMPLE IV

Alloy 7475 slab 4.5" thick was solution heat treated by heating to 910° F. and held at that temperature for 2 hours. The slab was then cooled to 645° F. at a rate of 40° F./hr. The slab was then immediately hot/warm rolled without a hold to a thickness of 1.191", with an exit temperature of 620° F. The metal was allowed to cool to a room temperature and then reheated to 300° F. and warm rolled to 0.25". The metal was then solution heat treated (recrystallized) for five minutes in a 920° F. salt bath and cold water quenched. The material thus produced had the following properties:

TABLE III

| Ave. Dia. | Grains/ $MM^2$ | ASTM Size | Ave. A. Dia. | Ave. B. Dia. | Aspect Ratio A/B |
|---|---|---|---|---|---|
| 11.54 | 7504 | 9.9 | 11.9 | 11.2 | 1.06 |

All grain diameter in μm

It is, of course, to be understood that the present invention is, by no means, limited to the specific disclosure presented herein, but also comprises any modifications within the scope of the affected claims.

We claim:

1. A method for producing superplastic aluminum alloy sheet or plate comprising the steps of:

a. providing an aluminum alloy slab of appropriate composition and thickness in an F. temper condition;

b. solution heat treating the aluminum alloy slab of step (a) at a temperature above about 860° F. from about ¼ to about 48 hours;

c. cooling the aluminum alloy slab of step (b) at a rate of between about 20° F./hr and about 100° F./hr to a temperature of between about 600° F. and about 700° F.;

d. hot/warm rolling the aluminum alloy slab of step (c), without prior overaging, at an entry temperature of between about 600° F. and 700° F. and at an exit temperature below about 600° F. to an intermediate gauge under conditions sufficient to impart sufficient strain energy and equivalent cold work as to yield a grain structure below about 20 μm after recrystallization;

e. cooling the product of step (d) to a temperature between about 200° F. and about 450° F.;

f. warm rolling the product of step (e) to final gauge; and g. rapidly recrystallizing the product of step (f).

2. The method of claim 1 wherein the cooling of step (c) further comprises holding the product at a temperature of between about 600° F. and about 700° F. for a period of up to eight hours prior to the initiation of hot/warm rolling at a temperature between about 600° F. and about 700° F.

3. The method of claim 1 wherein the cooling of step (e) comprises cooling the product of step (d) to ambient temperature and reheating the product to a temperature between about 200° F. and 450° F.

4. The method of claim 1 wherein the aluminum alloy slab comprises an alloy selected from the group consisting of the following aluminum alloys: 7075, 7475, 7050, 7150, X7091, 2034, 2219, 2124, 2014 and 6000 series alloys.

* * * * *